US005337502A

United States Patent [19]

Hopkins

[11] Patent Number: 5,337,502

[45] Date of Patent: Aug. 16, 1994

[54] PARTITIONED SIGN PANEL FOR BILLBOARDS

[76] Inventor: Robert L. Hopkins, 10019 Boedecker, Dallas, Tex. 75230

[21] Appl. No.: 982,780

[22] Filed: Nov. 30, 1992

[51] Int. Cl.[5] ..... G09F 15/00

[52] U.S. Cl. ..... 40/624; 40/605

[58] Field of Search ..... 40/624, 605; 52/309.4, 52/585, 587, 578

[56] References Cited

U.S. PATENT DOCUMENTS

| | | | |
|---|---|---|---|
| 1,130,844 | 3/1915 | Ruby | 40/624 |
| 1,853,141 | 4/1932 | Overholtz | 40/624 |
| 2,295,248 | 9/1942 | Wittner | 52/578 |
| 2,806,308 | 9/1957 | Curell | 40/624 |
| 2,836,266 | 5/1958 | Leeser | 52/578 |
| 2,885,808 | 5/1959 | Bastis | 40/624 |
| 2,948,976 | 8/1960 | Miller, Jr. | 40/624 |
| 3,176,418 | 4/1965 | Ramseur, Jr. | 40/624 |
| 3,659,365 | 5/1972 | Eaton . | |
| 3,760,548 | 9/1973 | Sauer et al. | 52/578 |
| 3,827,169 | 8/1974 | Chase et al. | 40/624 |
| 3,875,714 | 4/1975 | Nayler et al. | 52/309 |
| 4,275,520 | 6/1981 | Appleton et al. | 40/605 |
| 4,299,043 | 11/1981 | Lathrop et al. | 40/624 |
| 4,330,969 | 5/1982 | Quaney | 52/81 |
| 4,360,553 | 11/1982 | Landheer | 52/578 |
| 4,457,090 | 7/1984 | McDonough | 40/624 |
| 4,467,543 | 8/1984 | Townsend | 40/624 |

FOREIGN PATENT DOCUMENTS

| | | | |
|---|---|---|---|
| 2100044 | 12/1982 | United Kingdom | 40/624 |

*Primary Examiner*—Clifford D. Crowder
*Assistant Examiner*—Michael A. Neas
*Attorney, Agent, or Firm*—James W. Huffman

[57] ABSTRACT

A partitioned sign panel for billboards is provided by utilizing structural foam (high impact polystyrene) to form a 4'×7' rectangular sign panel. The sign panel includes raised ribs for support, double raised ribs for support and for use as cutting guides during construction of sign faces, clip channels which allow for placement of mechanical clips to connect the sides of two sign panels together, and extension ribs and slots for connecting the ends of two sign panels together.

9 Claims, 8 Drawing Sheets

PARTITIONED SIGN PANEL FOR BILLBOARDS

FIELD OF THE INVENTION

This invention relates generally to the field of display sign panels. More specifically, this invention relates to partitioned sign panels for use on advertising sign structures.

BACKGROUND OF THE INVENTION

A billboard is an advertising sign structure typically composed of wood, metal or some other durable material, upon which is attached a wood or metal advertising surface, situated outdoors along roads, on buildings, and in public places. Advertising surfaces are typically manufactured in sections. (Sections are typically 4' wide in the case of wooden sign faces, and 2' wide in the case of metal sign surfaces, and have a height pertaining to the height of the sign face, as will be further discussed below.) Slogans or graphics are painted or mounted onto the sections, and then the sections are mounted or hung together forming a sign face for display.

Billboards became popular in the 19th century as a means for advertising products and services when competition for wall and fence space forced advertisers to construct their own structures for displays. With the invention of the automobile and improvement of highway systems, the billboard increased in popularity as a way to capture the fleeting attention of motorists by displaying brief messages, or graphics which highlight or illustrate products.

Wood is the most popular material for the manufacture of sections because of its relative low cost, and because it can be configured in multiple sizes, as will be further discussed below. One problem with wooden sections, however, is that they are subject to deterioration and decay. After several years of exposure to sun, rain, and snow, wooden sections tend to rot, thus requiring replacement. It is not uncommon to have to replace wooden sections every 4–7 years.

Metal sections, typically composed of galvanized steel or aluminum, have increased in popularity due to their improved ability to withstand the elements. However, while metal sections do not decay or rot like wooden sections, they have a tendency to "snap" as the temperature varies from cold to hot, or vice versa. "Snap" refers to the shrinking or expanding of the metal as the temperature changes. When metal sections "snap", the advertisements that are painted on the metal tend to flake or peel off, thereby destroying the advertisement. To restore the advertisement, particular sections must be removed, repainted and remounted, a very costly process.

For the most part, sign faces have been standardized into four common sizes: 12'×24', 10'6"×36', 10'×40', and the most common 14'×48'. The construction of sign faces according to these sizes depends on whether the sign faces are manufactured out of wood or out of metal. As will be further discussed below in the Detailed Description, each sign face size requires specific sized sections that must be custom configured. For wooden sign faces, a carpenter is required to cut and match sections, according to specific dimensions, depending on the sign face size that he is to manufacture. For metal sign faces, sections must be manufactured according to specific dimensions, depending on the sign face size that is required. Thus, no common size stock is available that allows for easy construction of the above standardized sign faces.

SUMMARY OF THE INVENTION

The problems addressed above are solved and a technical advance is achieved by the present invention which provides an apparatus for increasing the durability of sign faces and providing a common size stock for the manufacture of standard size sign faces.

A partitioned sign panel for use in constructing sign faces for billboards, is provided which includes a rectangularly dimensioned flat surface, having a front side suitable for display of graphics, and a back side; a plurality of raised ribs, affixed to the back side of the surface, which provides structural support to the surface, a plurality of double raised ribs, affixed to the back side of the surface, that provides separation lines as guides for separating the panel into a plurality of separate pieces, means for connecting at least two of the panels to each other, end on end, to form a section; and means for connecting at least two of the panels to each other, side by side such that the means for connecting the two panels end on end, and the means for connecting the panels side by side, allow a plurality of the panels to be connected to form a sign face for billboards.

In one embodiment, the partitioned sign panel has a rectangularly dimensioned flat surface has a length of seven feet, and a width of four feet with at least seven ribs which have a length of seven feet, a width of at least one inch, and a depth of at least one-eighth inch which are mounted on the back side. In addition, at least two of the ribs are connected to the back side of said panel, and along the seven foot length of the panel, and parallel to each other, so as to form a first clip channel extending along a seven foot length of the panel. The partitioned sign panel also includes a second clip channel extending along the back side of the seven foot length of the panel, but adjacent to the first clip channel, which is formed by placing at least two of the ribs parallel to each other, and at least three inches apart from each other, and connecting the ribs to the back side of the panel.

An alternative embodiment includes a plurality of double raised ribs connected to the back side of the panel, which are parallel to each other, but perpendicular to the plurality of raised fibs. The double ribs are placed at least one-eighth inch from each other, thereby creating a space between each of the pairs of ribs to allow a cutting blade to be placed between each of the pairs of ribs.

An additional embodiment of the present invention includes extension ribs, which have a height and depth equivalent to that of the raised ribs, and a length of at least four inches, which are connected to one end of the panel, and extend therefrom; and slots, formed between the plurality of raised ribs at one end of the panel, and between the plurality of raised ribs where the double raised ribs are connected to the back side of the panel such that the slots are formed to allow the insertion of the extension ribs of another of the panels, thereby connecting the ends of two of the panels.

It is therefore an object of the present invention to utilize a material for the manufacture of sign faces that provides for more durability than treated wood or metal.

It is a feature of the present invention to use structural foam (high impact polystyrene) as a material for construction of sections.

It is an advantage of the present invention that the use of high impact polystyrene (with stabilizers and fillers) as a material for the manufacture of sections results in sections that do not decay or rot as rapidly as treated wood sections, and do not "snap" as do metal sections.

It is an additional advantage of the present invention that using high impact polystyrene as a material for the manufacture of sections allows waste, scrap, or damaged material discarded during construction of sections, to be melted and reused for construction of other products.

It is a further advantage of the present invention that using high impact polystyrene as a material for the manufacture of sections allows helpful marks, rulers or logos to be molded into the sections at little or no additional cost.

It is a further object of the present invention to provide a common size stock for the manufacture of sign faces so that custom manufacture of sign face sections is not required.

It is a feature of the present invention that partitioned sign panels are provided in 4'×7' dimensions, with double-ribbed dividers at 3', 3'6", and 5', to allow for easy manufacture of standard sign face sizes.

It is an advantage of the present invention that the use of partitioned sign panels in 4'×7' dimensions, with the above referenced double-ribbed dividers, allows for construction of standard sized sign faces, with little or no material waste, and without having to make custom measurements or cuts in their manufacture.

It is a feature of the present invention that partitioned sign panels are provided with clip channels along the perimeter of the longest sides, for easy placement of mechanical clips within the clip channels, for connection of multiple sections to each other.

It is an advantage of the present invention that the use of sections with the above referenced clip channels provide "nesting" of clip channels together during transportation, thereby reducing the total height of sections that are stacked together.

BRIEF DESCRIPTION OF THE DRAWINGS

The novel features believed characteristic of the present invention are set forth in the appended claims. The invention itself, however, as well as other objects, features and advantages, will be best understood by reference to the following detailed description of an illustrative embodiment when read in conjunction with the accompanying figures, wherein:

DETAILED DESCRIPTION OF THE INVENTION

Figure 1A:
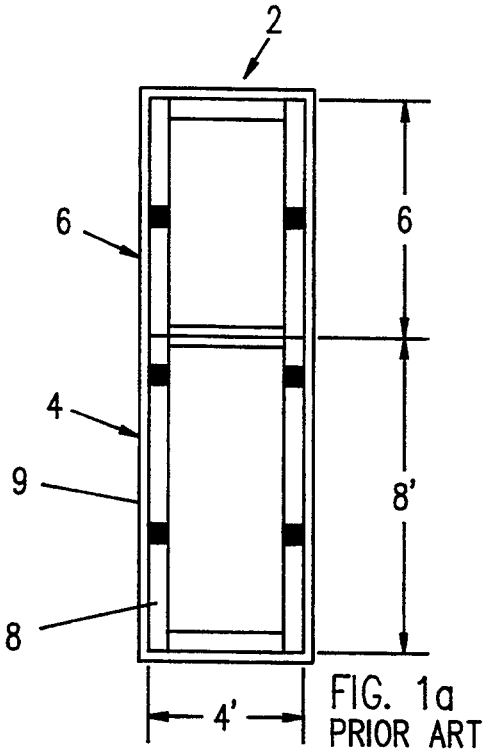
FIG. 1a PRIOR ART
FIGS. 1*a*, 1*b*, 1*c*, 2*a*, 2*b*, 3*a*, 3*b*, 4*a* and 4*b* are views illustrating treated wood and metal sign faces in the above referenced standard sizes composed of related wood or metal sections.
Figure 1B:
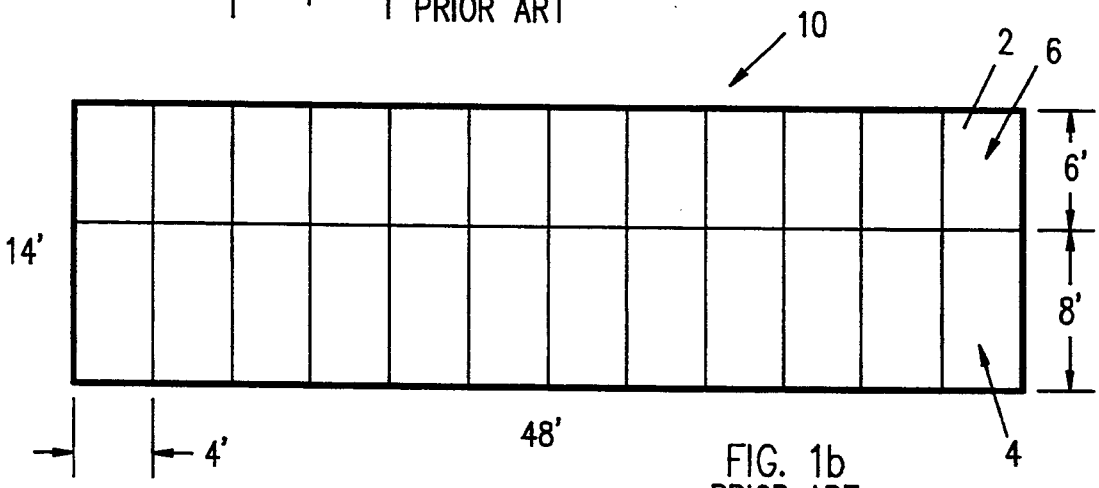
FIG. 1b PRIOR ART

Referring to FIG. 1*a*, a back view of a 4'×14' section 2 is shown. The section 2 is composed of a 4'×8' rectangular dimensioned piece of plywood 4, and a 4'×6' rectangular dimensioned piece of plywood 6, which are held together, end on end, by a support structure composed of a plurality of 2"×4" cross members 8. The section 2 is then placed vertically with a plurality of other sections 2 to form a sign face 10, as illustrated in FIG. 1*b*. The section 2 also includes mechanical clips 9 which allow the 14' sides of two sections 2 to be attached together, as discussed below with reference to FIG. 7, and allow the sections 2 to be hung vertically on a support structure, not shown.

Referring to FIG. 1*b*, a front view of a 14'×48' sign face 10 is shown which is manufactured out of treated wood. The sign face is composed of twelve sections 2 which are placed side by side in a vertical arrangement, as discussed above. It is understood, but not shown, by those skilled in the art that each of the sections 2 are connected to other sections 2 by means of mechanical clips 9, attached to the back of the cross members 8.

Figure 1C:
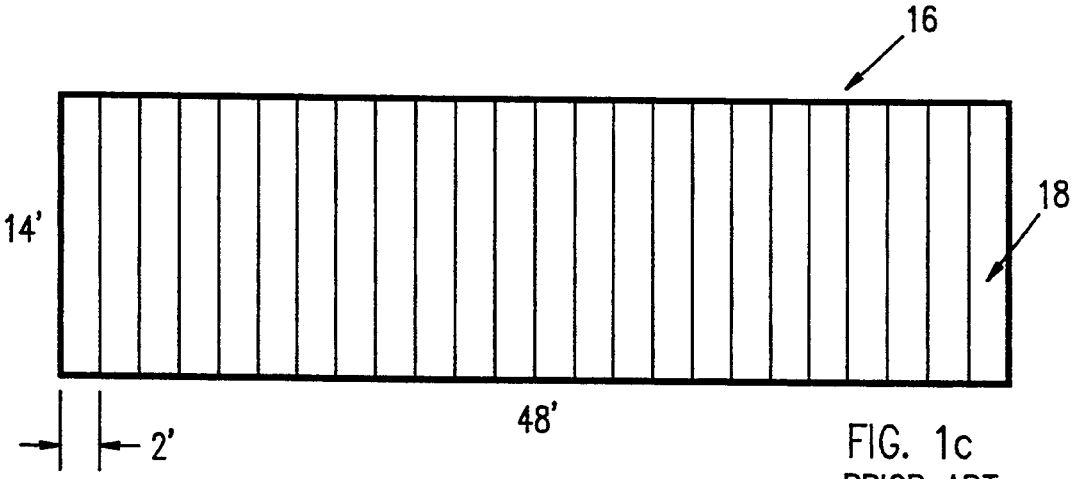
FIG. 1c PRIOR ART

Referring to FIG. 1*c*, a 14'×48' sign face 16 is shown which is manufactured out of twenty four pieces 18 of 2'×14' galvanized metal or aluminum. Each of the pieces 18 are arranged side by side with the 14' length of each piece 18 placed adjacent another 14' piece. It is understood, but not shown, by those skilled in the art that each of the 2'×14' pieces of metal or aluminum are connected to each other by means of metal clips attached to the back of each piece of metal 18.

Figure 2A:
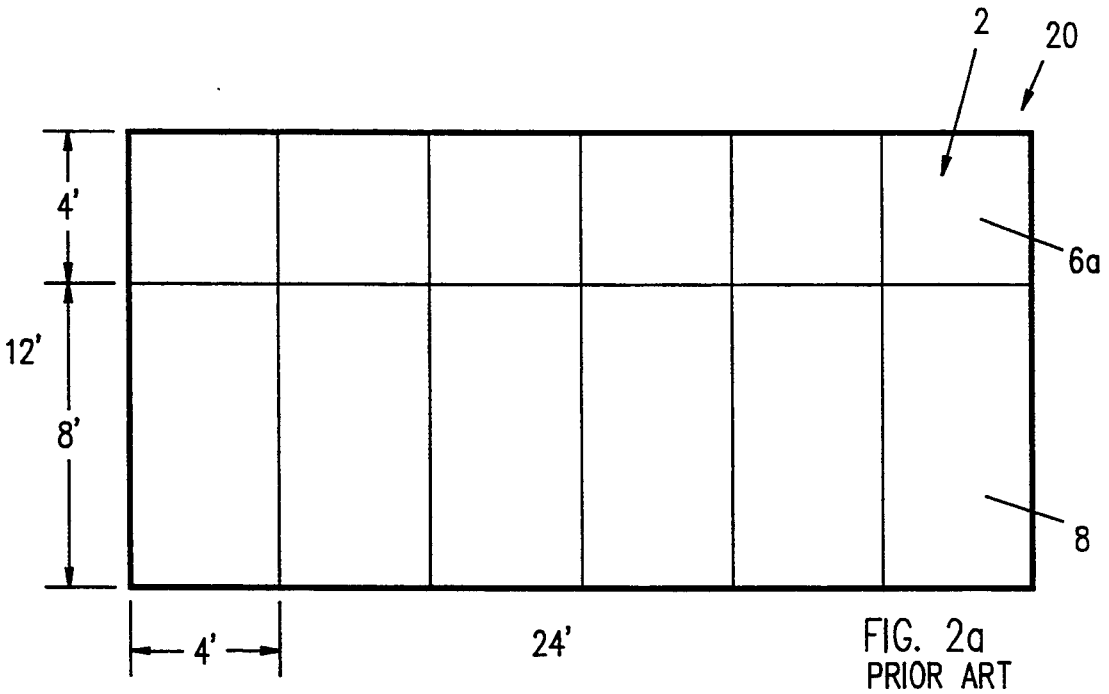
FIG. 2a PRIOR ART

Referring to FIG. 2*a*, a 12'×24' sign face 20 is shown which is manufactured out of treated wood. The sign face 20 is composed of six sections 2, as discussed above, but with the following modification. Each section 2 for sign face 20 has a rectangular dimension of 4'×12' (rather than 14'). Thus, the bottom piece of plywood 8 has a rectangular dimension of 4'×8', but the top piece of plywood 6*a* has a rectangular dimension of 4'×4'. It is understood, but not shown, by those skilled in the art that each of the 4'×12' sections are connected to each other by means of mechanical clips, as discussed above.

Figure 2B:
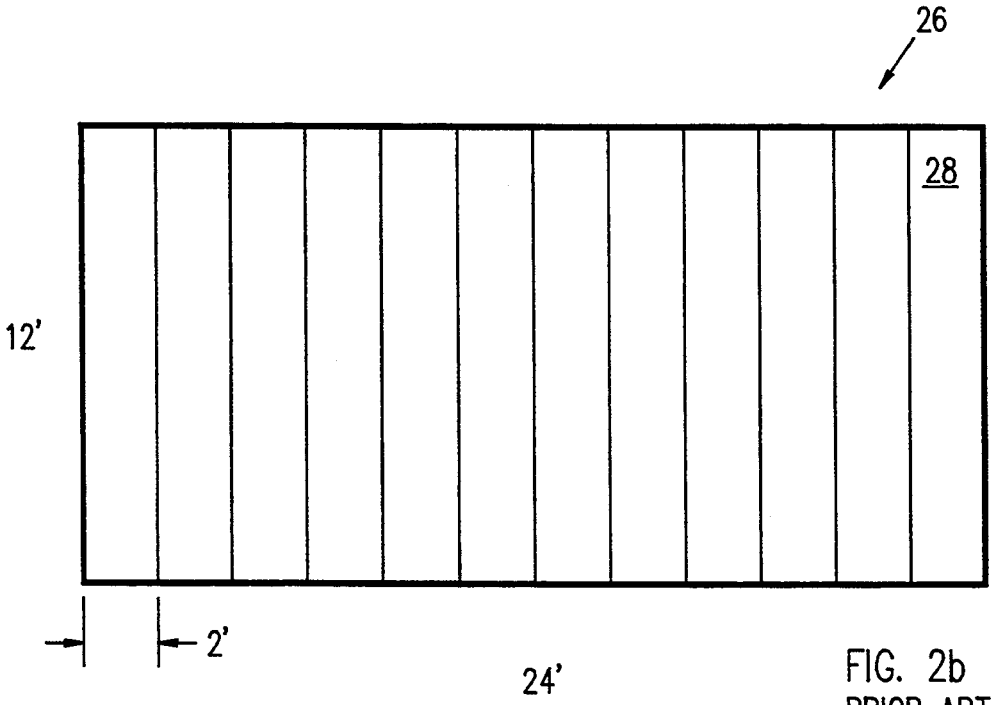
FIG. 2b PRIOR ART

Referring to FIG. 2*b*, a front view of a 12'×24' sign face 26 is shown which is manufactured out of twelve pieces 28 of 2'×12' galvanized metal or aluminum. Each of the pieces 28 are arranged side by side with the 12' length of each piece 28 placed adjacent another 12' piece. It is understood, but not shown, by those skilled in the art that each of the 2'×12' pieces of metal or aluminum are connected to each other by means of mechanical clips attached to the back of each piece of metal 28.

Figure 3A:
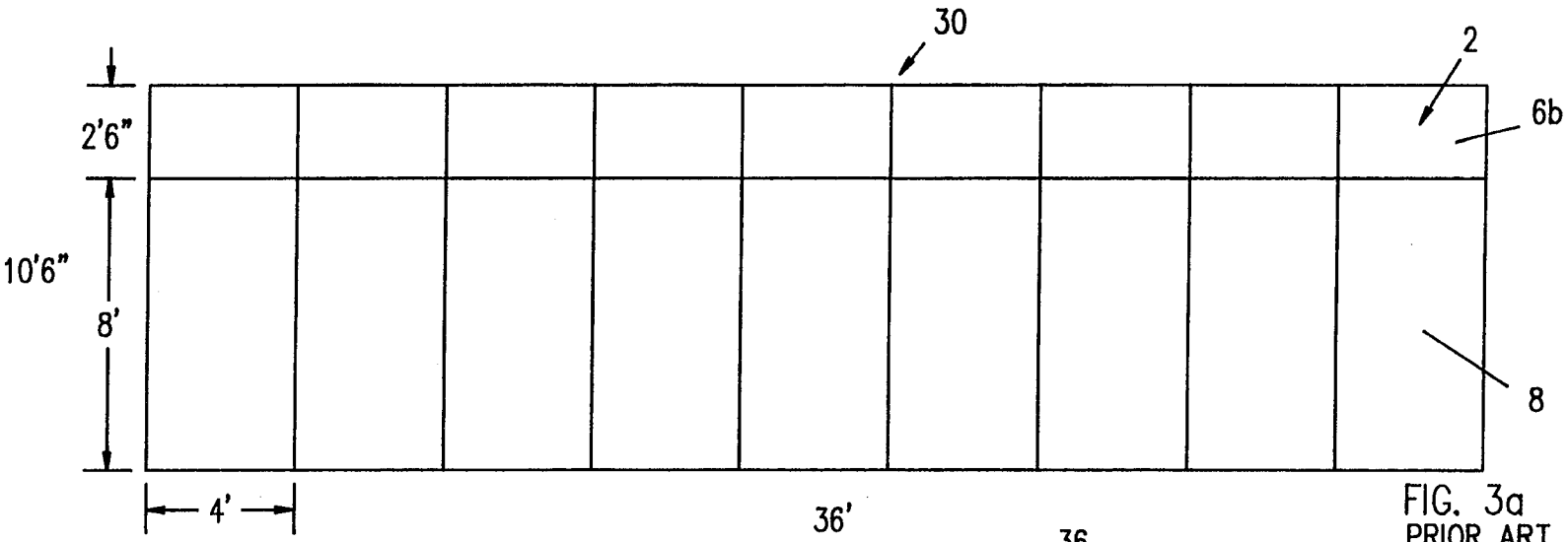
FIG. 3a PRIOR ART

Referring to FIG. 3*a*, a 10'6"×36' sign face 30 is shown which is manufactured out of treated wood. The sign face 30 is composed of nine 4'×10'6" sections 2, as discussed above, but with the following modification. Each section 2 for sign face 30 has a rectangular dimension of 4'×10'6" (rather than 14'). Thus, the bottom piece of plywood 8 has a rectangular dimension of 4'×8', but the top piece of plywood 6*b* has a rectangular dimension of 4'×2'6". It is understood, but not shown, by those skilled in the art that each of the 4'×10'6" sections 2 are connected to each other by means of mechanical clips, as discussed above.

Figure 3B:
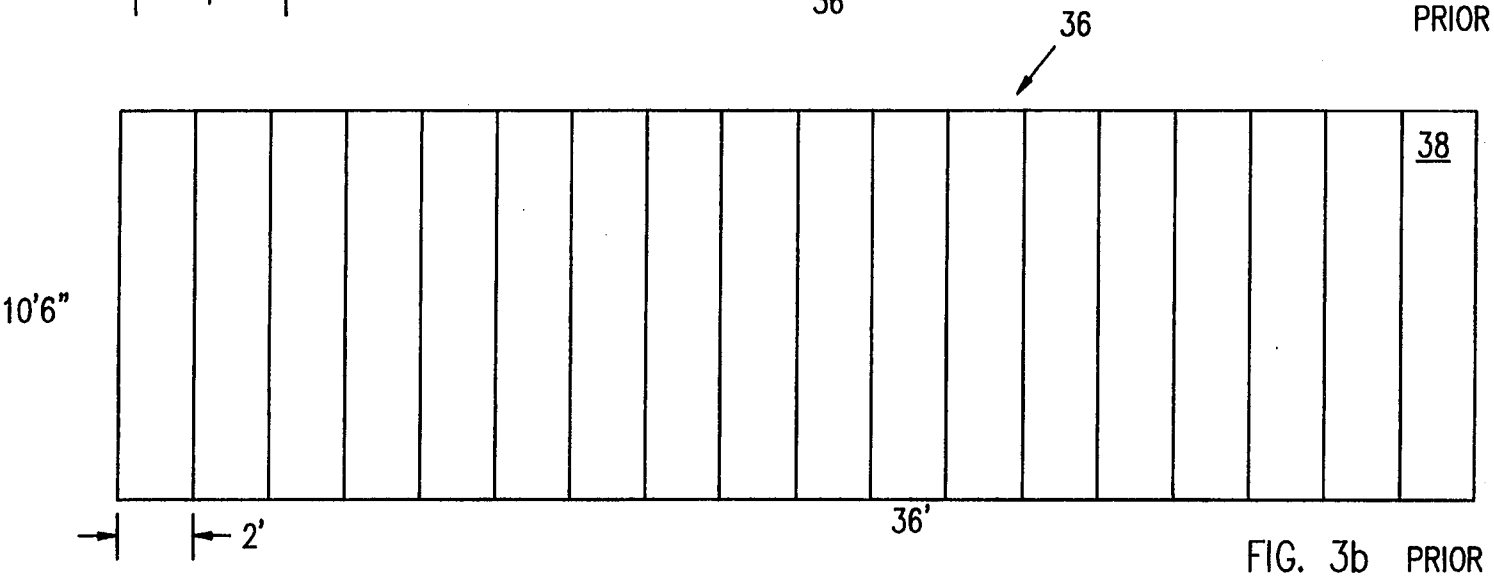
FIG. 3b PRIOR ART

Referring to FIG. 3*b*, a 10'6"×36' sign face 36 is shown which is manufactured out of eighteen pieces 38 of 2'×10'6" galvanized metal or aluminum. Each of the pieces 38 are arranged side by side with the 10'6" length of each piece 38 placed adjacent another 10'6" piece. It is understood, but not shown, by those skilled in the art that each of the 2'×10'6" pieces of metal or aluminum are connected to each other by means of metal clips attached to the back of each piece of metal 38.

Figure 4A:
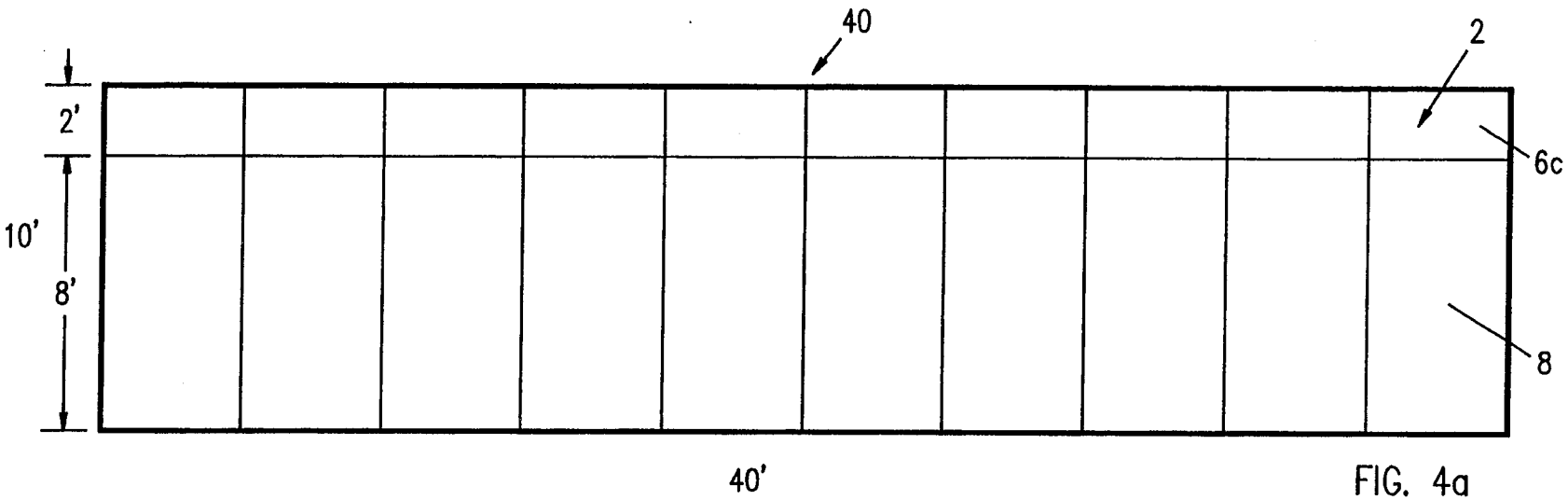
FIG. 4a PRIOR ART

Referring to FIG. 4*a*, a front view of a 10'×40' sign face 40 is shown which is manufactured out of treated wood. The sign face 40 is composed of ten 4'×10' sections 2, as discussed above, but with the following modification. Each section 2 for sign face 40 has a rectangular dimension of 4'×10' (rather than 14'). Thus, the bottom piece of plywood 8 has a rectangular dimension of 4'×8', but the top piece of plywood 6*c* has a rectangular dimension of 4'×2'. It is understood, but not shown, by those skilled in the art that each of the 4'×10' sections 2 are connected to each other by means of mechanical clips, as discussed above.

Figure 4B:
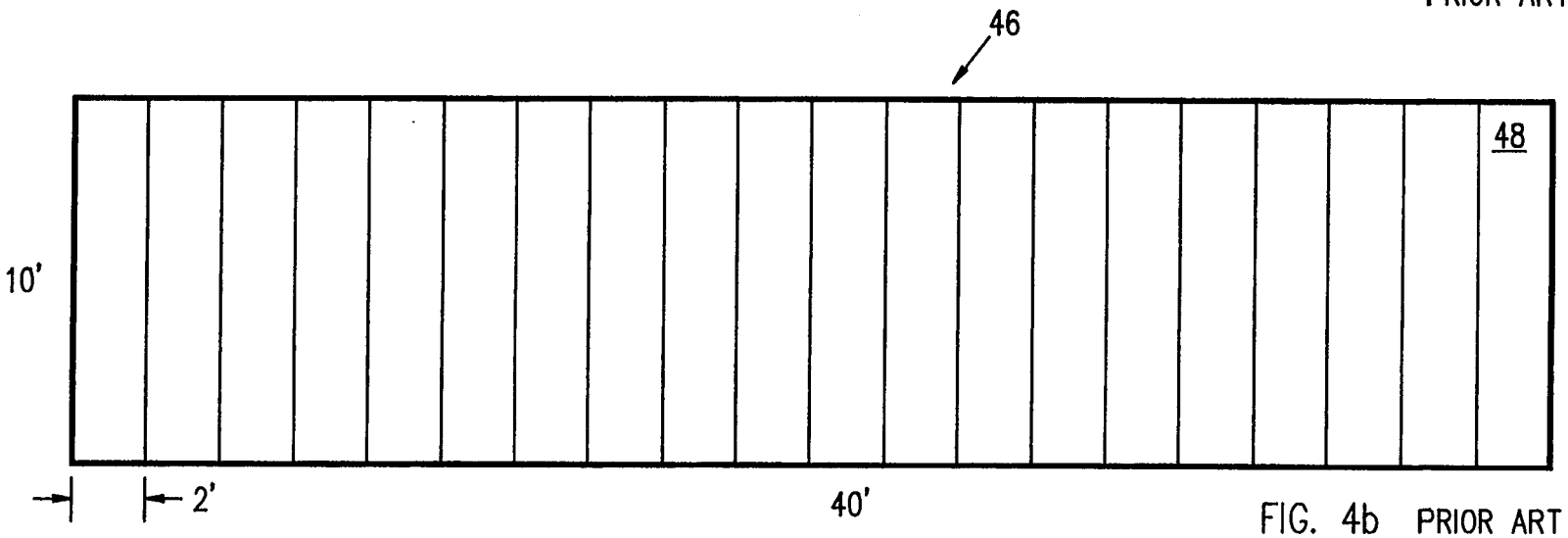
FIG. 4b PRIOR ART

Referring to FIG. 4*b*, a 10'×40' sign face 46 is shown which is manufactured out of twenty pieces 48 of 2'×10' galvanized metal or aluminum. Each of the pieces 48 are arranged side by side with the 10' length of each piece 48 placed adjacent another 10'piece. It is understood, but not shown, by those skilled in the art that each of the 2'×10' pieces of galvanized metal or aluminum are connected to each other by means of mechanical clips attached to the back of each piece of metal 48.

It is understood that each of the above treated wood or metal sign faces, represented by FIGS. 1–4, are well known in the art, and that construction of each of the standard sizes, mounting of each of the sections, and arrangement of support 2'×4's is also well known. The above has been shown to illustrate that for each of the standard sign face sizes, a unique configuration of treated wood or metal sections is required to obtain the desired sign face. For treated wood sign faces, four distinct arrangements of plywood are required to manufacture the four standard sizes. In addition, specific measurements and cuts must be made to 4'×8' sheets of plywood to obtain desired section dimensions in the four sign face types. As for the metal sign faces, each sign face size requires the manufacture of specific length metal pieces. Thus, neither the treated wood sign faces, nor the metal sign faces, are readily manufactured from common sized stock without requiring special measurements, cuts or manufacturing.

Figure 5:
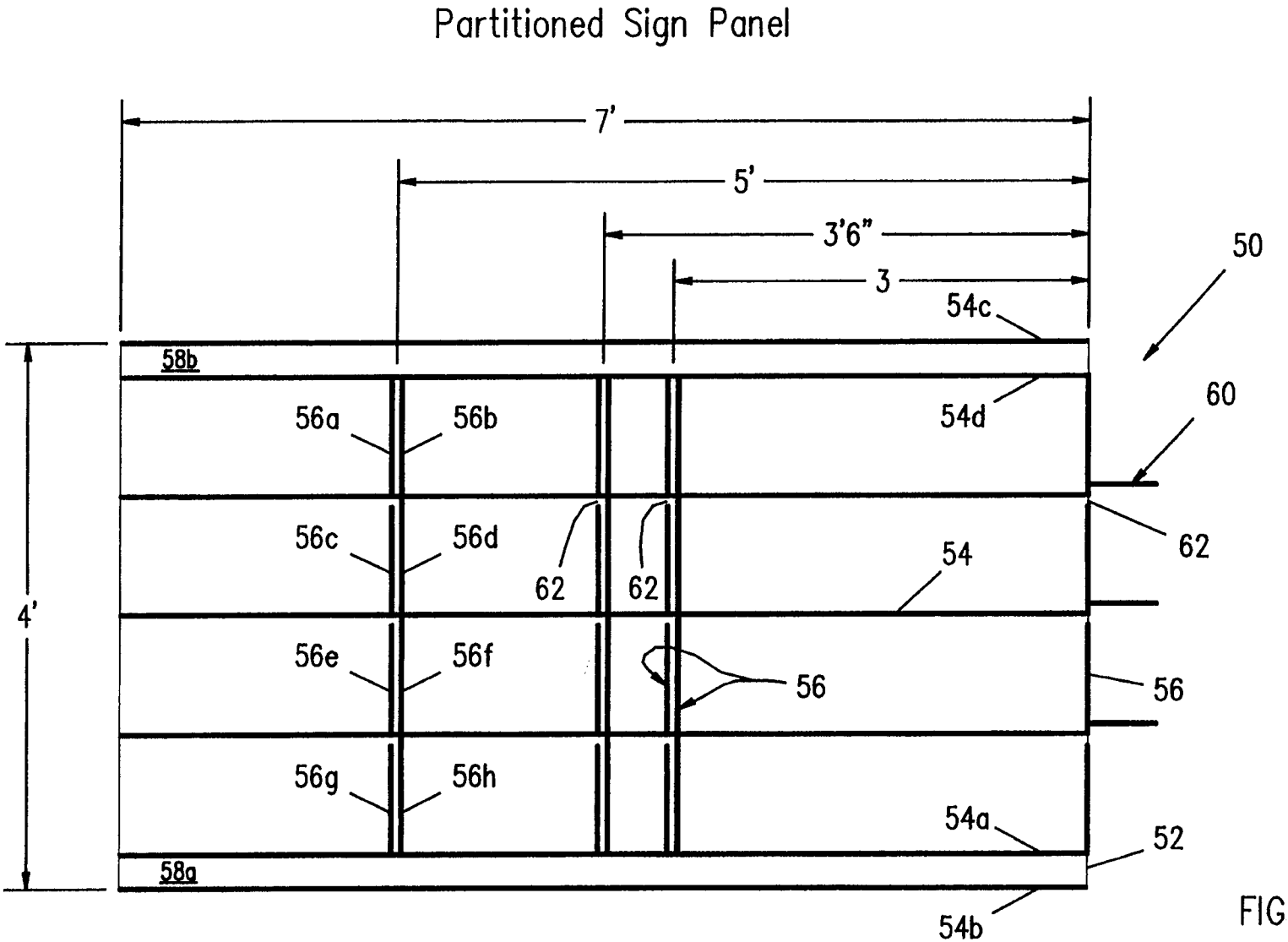
FIG. 5 is a back view of the partitioned sign panel according to the present invention.

Referring to FIG. 5, a back view of an embodiment of the present invention is shown. A partitioned sign panel 50 is provided that is 4'×7' in rectangular dimension. In one embodiment of the invention, the partitioned sign panel 50 is manufactured from structural foam (high impact polystyrene). The sign panel 50 is meant to be combined with other sign panels 50 as illustrated with reference to FIGS. 6 & 7 to form a sign face. In addition, the sign panel 50 provides a common size stock for manufacturing all of the standard size sign faces, as will be further discussed with reference to FIG. 7.

The partitioned sign panel 50 includes a flat surface 52 which is 4'×7' in rectangular dimension, a plurality of raised ribs 54 which are mounted perpendicular to the surface 52, to provide support for the surface 52, a plurality of double raised ribs 56 which are mounted perpendicular to the surface 52, and perpendicular to the raised ribs 54, which provide structural support for the surface 52, and provide a measured line of separation for the panel 50, as will be further discussed below.

In addition, the sign panel 50 includes clip channels 58*a*, 58*b* which extend along the perimeter of the 7' length, and extension ribs 60 which protrude from one of the 4' ends of the sign panel 50, for insertion into slots 62 of another sign panel 50, as will be further discussed below.

In one embodiment of the invention, the flat surface 52 is 4'×7' in rectangular dimension, and is approximately ¼" thick. The flat surface 52 provides a surface area upon which advertisements or graphics may be painted, or mounted. To provide rigidity or stiffness to the flat surface 52, a plurality of raised ribs 54 are placed onto the back of the flat surface 52. In one embodiment of the invention, seven raised ribs 54 are mounted parallel to each other, and perpendicular to the back surface 52. The raised ribs 54 are approximately 7'×1"×¼" in dimension. The ¼" side of the ribs 54 are affixed to the back side and extend along the 7' length of the surface 52.

A rib 54*b* is positioned on the lower outside 7' perimeter of the surface 52 to provide structural support for the surface 52, and to provide a surface for attaching the sign panel 50 to another sign panel 50, as will be discussed with reference to FIG. 7. A rib 54*a* is positioned approximately 4" from the rib 54*b*, and parallel to the rib 54*b*, to provide structural support for the surface 52, and to form a clip channel 58*a* between the ribs 54*a* and 54*b*. The clip channel 58*a* allows mechanical clips, not shown, to be affixed within the channel 58*a*, to the sign panel 50. The mechanical clips are then used to connect multiple sign panels 50 to each other along their 7' lengths, and to allow the multiple sections to be hung vertically on the support structure, as discussed above.

In a similar manner, rib 54*c* is positioned on the upper outside 7' perimeter of the surface 52 to provide structural support for the surface 52, and to provide a surface for attaching the sign panel 50 to another sign panel 50, as will be discussed with reference to FIG. 7. A rib 54*d* is positioned approximately 4" from the rib 54*c*, and parallel to the rib 54*c*, to provide structural support for the surface 52, and to form a clip channel 58*b* between the ribs 54*c* and 54*d*. The clip channel 58*b* allows mechanical clips to be used, as discussed above, to connect multiple sign panels 50 to each other along their 7' lengths.

For additional structural support of surface 52, double raised ribs 56 are mounted perpendicular to the ribs 54, and perpendicular to the surface 52. The ribs 56 are approximately 1" wide by ¼" deep in dimension, with a length sufficient to connect ribs 54. The double ribs 56 are also mounted ¼" from each other and in parallel. More specifically, ribs 56*a*, 56*b*, 56*d*, 56*f* and 56*h* have lengths which extend between and connect ribs 54. Ribs 56*c*, 56*e* and 56*g* are mounted in a similar fashion, but have lengths which are approximately ¼" shorter than their adjacent ribs 56. The ¼" gap between the ribs 54 created by ribs 56*c*, 56*e* and 56*g* allows insertion of the extension ribs 60, as discussed below with reference to FIG. 6.

The double ribs 56 are spaced parallel to each other with ¼" separation between the ribs, i.e., ¼" space between ribs 56*a* and 56*b*, for example. Such spacing allows a cut to be made between the double ribs 56, by a circular saw, for example, to separate the sign panel 50 into two or more pieces. By providing the double ribs 56 on the panel 50, accurate cuts may be easily made between the fibs. In addition, after the sign panel 50 is cut into two pieces by a cut made between the double ribs 56, each piece retains one side of the double ribs 56 for support of its surface 52.

In one embodiment of the invention, the double raised ribs 56 are placed at specific distances from one end of the sign panel 50. More specifically, the double ribs 56 are positioned at distances of 3', 3'6" and 5' from the 4' end of the sign panel 50 that has the extension ribs 60. The placement of the double ribs 56 at these positions provides for the cuts required to assemble the four standard size sign faces, as shown in FIG. 7.

Figure 6A:
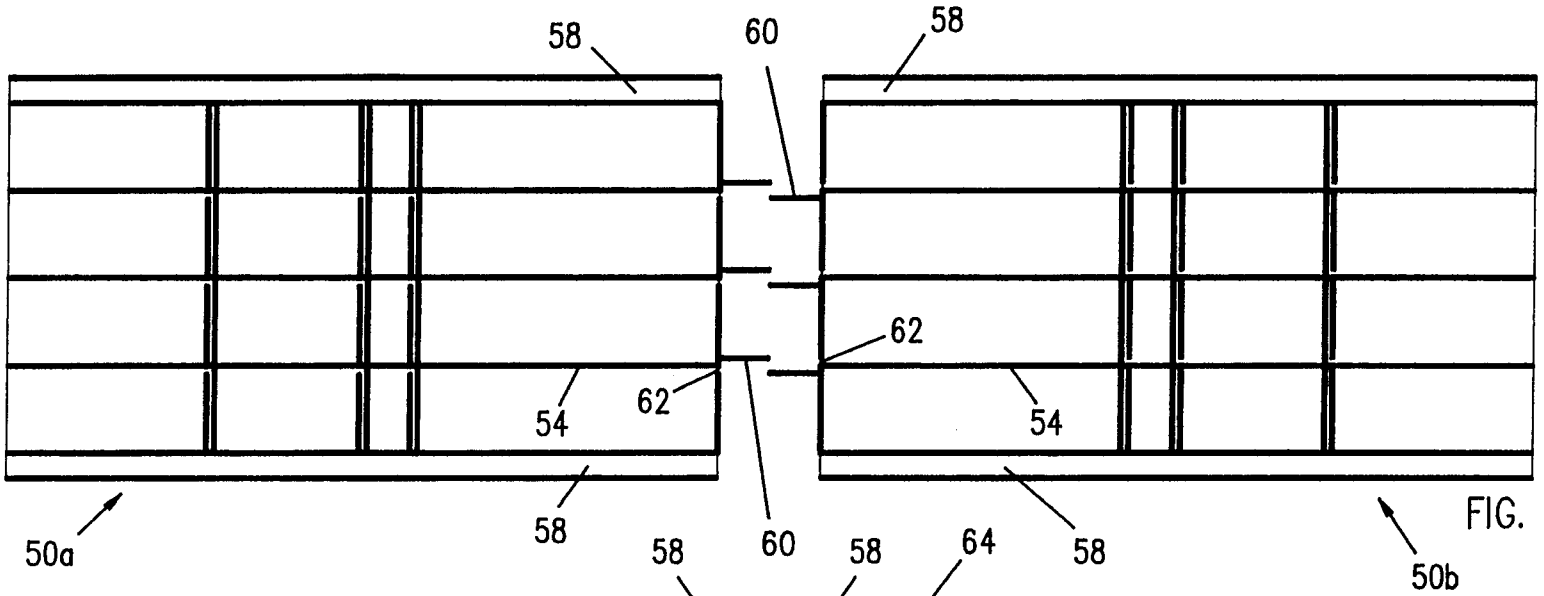
FIGS. 6*a* and 6*b* are back views of partitioned sign panels according to the present invention, which illustrate the interconnection of two sign panels to form a section.

Referring to FIG. 6*a*, two sign panels 50 according to the present invention are shown. Sign panel 50*a* is shown in the same orientation as discussed with reference to FIG. 5. Sign panel 50*b* is shown rotated 180° about the y-axis. In FIG. 6*a*, sign panels 50*a* and 50*b* are shown in a end by end relationship. As can be seen, the extension ribs 60 on the sign panels 50 are offset from the raised ribs 54 by an amount equal to the width of the ribs 54. In one embodiment of the invention, the extension ribs 60 are offset approximately ¼" from the ribs 54. In addition, slots 62 are formed between the vertically placed ribs 56 and the horizontally placed ribs 54 in an amount equal to the width of the extension ribs 60, as discussed above. The slots 62 are offset from the raised ribs 54 in an amount equal to the offset of the extension ribs 60 from the ribs 54, but in the opposite direction. It is understood that by rotation of sign panel 50*b* by 180° about the y-axis, the extension ribs 60 of sign panels 50*a*, 50*b* are readily insertable into the slots 62 of sign panels 50*b*, 50*a*, respectively. The surfaces of the extension ribs 60 and the raised ribs 54 may then be attached by using an adhesive, a contact cement, or other bonding material, or by mechanical fasteners (bolts, rivits, etc.) that are well known in the art.

Figure 6B:
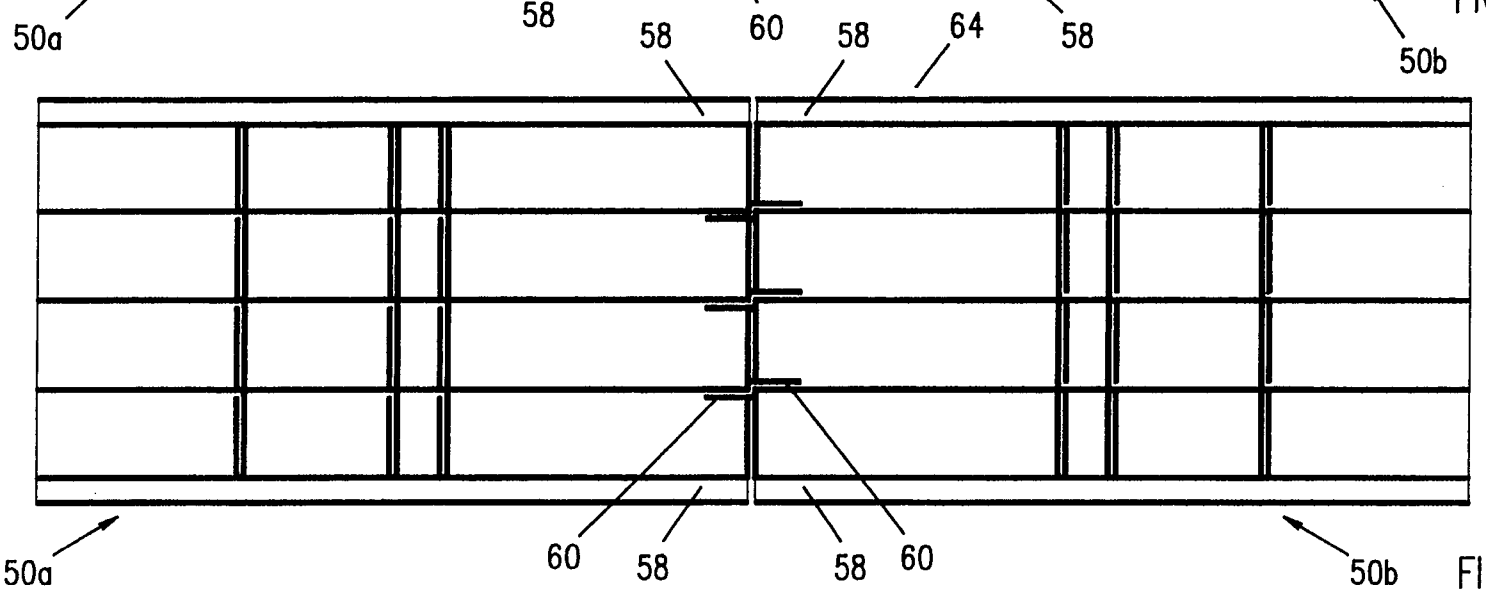

Referring to FIG. 6*b*, the sign panels 50*a* and 50*b* of FIG. 6*a* are shown connected in the manner discussed above. Such connection forms a section 64 that is 4'×14' in rectangular dimension. The section 64 may then be used to construct any of the standard size sign faces, as will be discussed below with reference to FIG. 7.

Figure 7:
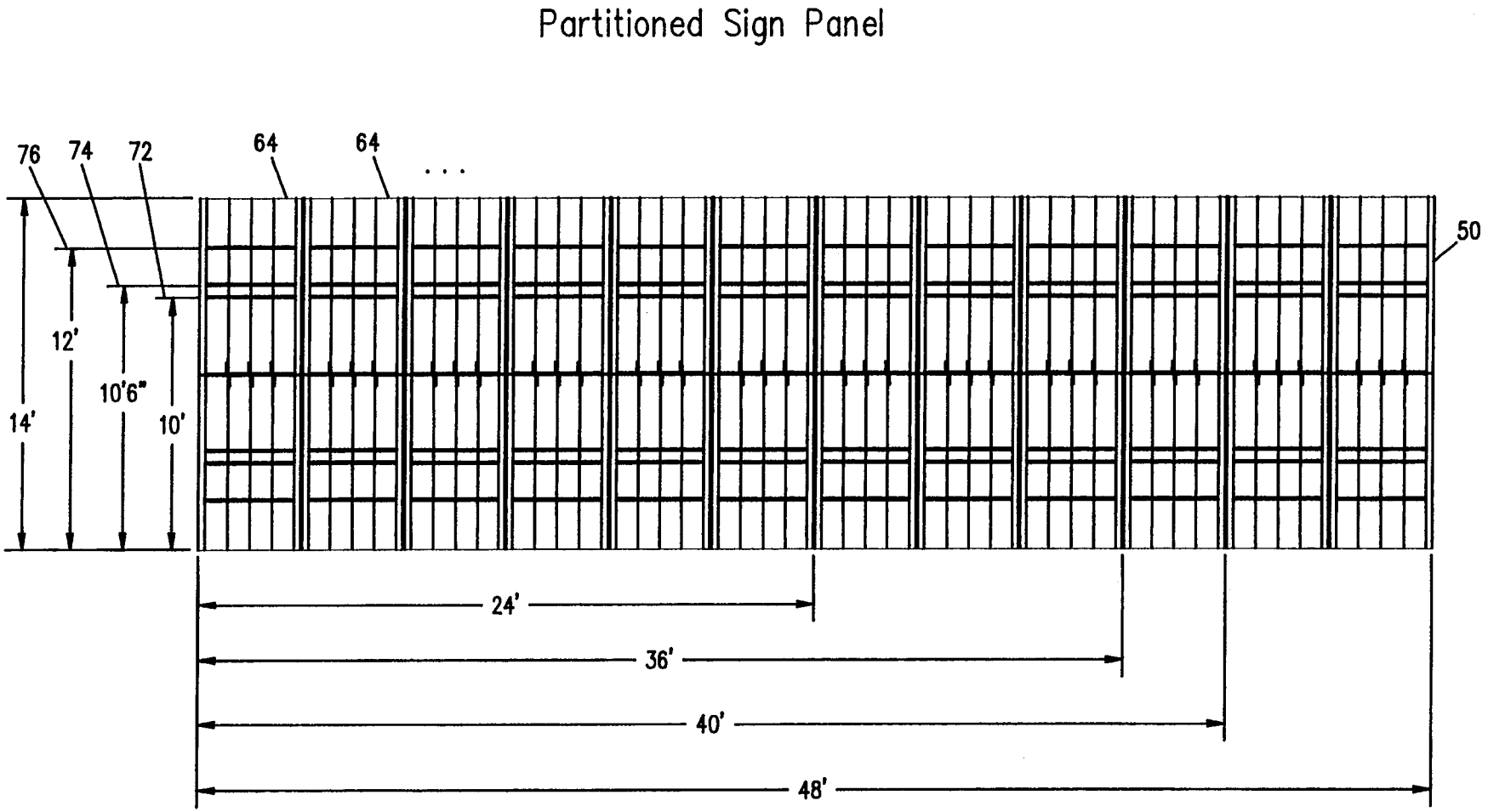
FIG. 7 is a back view of a plurality of partitioned sign panels according to the present invention, which illustrate the interconnection of a plurality of sections to form sign faces according to the above referenced standard sizes.

Referring to FIG. 7, the back side of a plurality of sign panels 50 are shown connected in the manner discussed above, to form 4'×14' sections 64. The sections 64 are then placed side by side for construction of any of the four standard size billboards. Each section 64 may be connected to another section 64 by utilizing mechanical clips, not shown, which are placed within the clip channels 58 of each sign panel 50. The clips are mounted on spacer blocks that are about 4" long and have the same width and depth as the clip channels 58. These spacer blocks allow the clips to sit flush with the back of the sign panels 50. The clips not only hold the sections 64 onto the support structure, but also allow for a pin and shim connector, not shown, to hold adjacent sections together via pre-drilled holes in the sides of the clips. Use of clips to attach adjacent panels is well known in the art of treated wood panels, and will not be discussed further. However, it should be understood, with reference to FIGS. 5–7, that the clips used to attach adjacent sections may be placed anywhere within the clip channels 58, to accomodate the spacing of the support structure upon which the sections 64 are hung.

If a sign face size of 14'×48' is desired, then twenty-four of the sign panels 50 are joined together in the manner shown. For example, top and bottom sign panels 50 are bonded together in the manner discussed with reference to FIGS. 6*a* and 6*b*, forming a section 64. The sections 64 are then attached, side by side through the use of the mechanical clips. Thus, when a 14'×48' sign face is desired, twenty-four sign panels 50 of a common stock size may be arranged such that no material is wasted, and no customization is required in either manufacturing or construction.

If a sign face size of 10'×40' is desired, twenty sign panels 50 are arranged in the following manner. Twenty sign panels 50 are used to construct 10 sections 64 as discussed with reference to FIGS. 6*a* and 6*b*. The ten sections 64 are then placed side by side to form a 14'×40' sign face of rectangular dimension. A single cut may then be made between the double ribs 56 at the 3' position as referenced in FIG. 5, and as illustrated as position 72. After the cut is made, a 10'×40' sign face remains. It should be noted that the cut along the 3' position also produces a 4'×40' sign face, or ten 4'×4' portions. These portions may be cut again at the 3'6" position to form other sized sign faces as discussed below.

If a sign face size of 10'6"×36' is desired, eighteen sign panels 50 are arranged in the following manner. Eighteen sign panels 50 are used to construct nine sections 64 as discussed above. The nine sections 64 are then placed side by side to form a 14'×36' sign face of rectangular dimension. A single cut may then be made between the double ribs 56 at the 3'6" position as referenced in FIG. 5, and as illustrated as position 74. After the cut is made, a 10'6"×36' sign face remains. It should be noted that when the cut is made at the 3'6" position, the remainder of the sign face that is cut away from the 10'6"×36' sign face has the dimension of 3'6"×36". This remainder may be used to construct another 10'6"×36' sign face by attaching the remainder to the top of nine sign panels 50. As shown in FIG. 5, the double ribs 56 at the 3', 3'6" and 5' lengths all have slots 62 to allow insertion of extension ribs 60. As remainders are cut away, the remainder slots 62 allow insertion of extension ribs 60 from other partitioned sign panels 50. Thus, the 10'6"×36' sign face was constructed from common stock, without any material waste, and without any customization in manufacturing.

Finally, if a sign face size of 12'×24' is desired, twelve sign panels 50 are arranged in the following manner. Twelve sign panels 50 are used to construct six sections 64 as discussed above. The six panels 64 are then placed side by side to form a 14'×24' sign face of rectangular dimension. A single cut may then be made between the double ribs 56 at the 5' position as referenced in FIG. 5, and as illustrated as position 76. After the cut is made, a 12'×24' sign face remains. This sign face is built without any customization in manufacturing, and with only a single cut in construction.

Figures 8, 9:
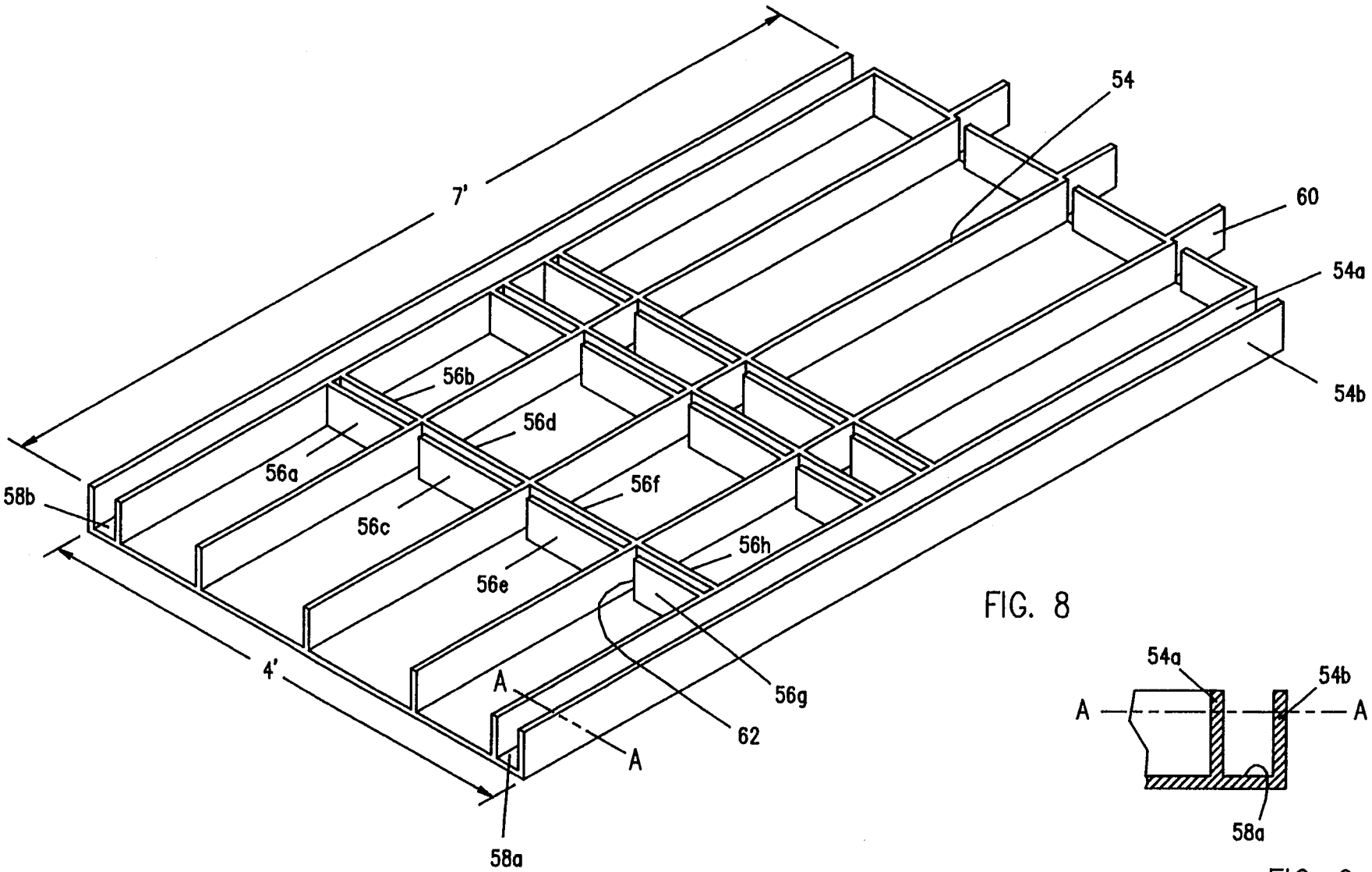
FIG. 8 is a top perspective view of the partitioned sign panel according to the present invention.
FIG. 9 is a front cross section view of the clip channel of the present invention taken along line A—A of FIG. 8.

Now referring to FIG. 8, the sign panel of the present invention is shown in perspective view. Illustrated are the double ribs 56 which are mounted ¼" from each other and in parallel. The ¼" gap between the ribs 54 created by ribs 56*c*, 56*e* and 56 *g* allow insertion of the extension ribs 60, as discussed above with reference to FIG. 6. Also shown the clip channels 58 having a base 58*a* and side wall partitions 54*a* and 54*b* which allow for placement and mounting and mechanical chips. A cross section of the clip channel 58 along line A—A is shown in FIG. 9.

In addition to the above features and advantages of utilizing a 4'×7' partitioned sign panel of structural foam as common stock to manufacture sign faces, other features and advantages are also provided. For example, in another embodiment of the invention, the use of structural foam allows numerous, but helpful, items to be molded into the 4′×7′ sign panels 50. One such item includes molding a ruler along the clip channels 58 as an aid in exact placement of the mechanical clips. The ruler could be molded to start at either end, or at both ends, since two 7′ sign panels would not have a definite top or bottom. In addition, "center punch" marks could be molded into the clip channels 58 at the three or four common clip spacings that are widely used in the industry. These "center punch" marks could provide drill guides for easy placement and alignment of the mechanical clips within the clip channels 58.

Another embodiment of the present invention provides a male/female tongue and groove on the outside edge of the raised rib 54 on the 7′ length. One aspect of the invention provides a male groove at one end of the 7′ length that transitions linearly into a female groove at the other end of the 7′ length. On the opposite 7′ length, an inverse is provided. Such tongue and groove arrangement on the outside rib 54 of the sign panel 50 allows easy alignment of side by side sign panels. An additional advantage of the tongue and groove molding is the prevention of light gaps that might occur between two sign panels that are not closely joined.

Although illustrative embodiments of the present invention have been shown and described, a latitude of modification, change and substitution is intended in the foregoing disclosure, and in certain instances some features of the invention will be employed without a corresponding use of other features. Accordingly, it is appropriate that the appended claims be construed broadly and in a manner consistent with the scope of the invention.

What is claimed is:

1. A partitioned sign panel for use in constructing sign faces for billboards, the sign panel comprising:

a) a generally rectangular plate like body, having a front side suitable for display of graphics, and a back side;

b) a first pair of said raised ribs, connected to the back side of said body, at approximately three feet from a first end of said body;

c) a second pair of said raised ribs, connected to the back side of said body, at approximately three feet, six inches from said first end of said body; and d) a third pair of said raised ribs, connected to the back side of said body at approximately five feet from said one end of said body;

e) wherein the position of each pair of said raised ribs provides separation lines as guides for separating said body into a plurality of separate pieces at fixed distances from said first end of said body a plurality of raised ribs, affixed to said back side of said body, for providing structural support to said body; and for providing separation lines as guides for separating said body into a plurality of separate pieces;

f) means for connecting said body to an additional, but identical body, end on end, to form a section; and g) means for connecting said body to an additional, but identical body, side by side:

h) whereby said means for connecting said body to an additional, but identical body, end on end, and said means for connecting said body to an additional, but identical body, side by side, allow a plurality of said bodies to be connected to form a sign face for billboards.

2. A partitioned sign panel for use in constructing sign faces for billboards, the sign panel comprising:

a) a generally rectangular plate like body, having a front side suitable for display of graphics, and a back side:

b) a plurality of raised ribs, affixed to said back side of said body, for providing structural support to said body; and for providing separation lines as guides for separating said body into a plurality of separate pieces;

c) means for connecting said body to an additional, but identical body, end on end, to form a section comprising:

1) extension ribs, which have a height and depth equivalent to that of said raised ribs, and a length of at least four inches, which are connected to one end of said body, and extend therefrom wherein said extension ribs are connected to said first end of said body along axes which are parallel to said raised ribs, but which are offset from the axes of said raised ribs by an amount equal to the depth of said extension ribs;

2) slots, formed between said plurality of raised ribs at a first end of said body:

3) wherein said slots are formed to allow the insertion of extension ribs of an additional, but identical body, thereby connecting said first end of said body to a first end of said additional, but identical body; and d) means for connecting said body to an additional, but identical body, side by side;

e) whereby said means for connecting said body to an additional, but identical body, end on end, and said means for connecting said body to an additional, but identical body, side by side, allow a plurality of said bodies to be connected to form a sign face for billboards.

3. The partitioned sign panel of claim 2, wherein said slots are formed along axes which are parallel to said raised ribs, but which are offset from the axes of said raised ribs by an amount equal to the depth of said extension ribs, and which are offset on the opposite side of said axes of said raised ribs from said extension ribs.

4. The partitioned sign panel of claim 3, wherein said extension ribs of said body may be inserted into slots of said second, but identical body, when said second body is rotated approximately 180° along the x-axis such that said first end of said body is connected to said first end of said second, but identical body.

5. A partitioned sign panel for use in constructing sign faces for billboards, the sign panel comprising:

a) a generally rectangular plate like body, having a front side suitable for display of graphics, and a back side:

b) a plurality of raised ribs, affixed to said back side of said body, for providing structural support to said body; and for providing separation lines as guides for separating said body into a plurality of separate pieces;

c) means for connecting said body to an additional, but identical body, end on end, to form a section; and d) means for connecting said body to an additional, but identical body, side by side, wherein said means comprise;

1) clip channels, extending along the sides of said back side of said body, and formed between at least two of said raised ribs on one length of said body, and between at least two of said raised ribs on the other length of said body;

2) mechanical clips, mounted within said clip channels for attaching to additional, but identical, mechanical clips;

3) wherein said mechanical clips are mounted in said clip channel opposite to mechanical clips mounted in a clip channel in said additional, but identical body, when said body and said additional, but identical body are positioned in a side by side relationship;

e) whereby said means for connecting said body to an additional, but identical body, end on end, and said means for connecting said body to an additional, but identical body, side by side, allow a plurality of said bodies to be connected to form a sign face for billboards.

6. The partitioned sign panel of claim 5 wherein said rectangular plate like body has a length of seven feet, and a width of four feet.

7. The partitioned sign panel of claim 5 wherein said body is manufactured out of high impact foam.

8. A partitioned sign panel for use in constructing a sign face for billboards by connecting a plurality of the sign panels to each other to form the sign face; the partitioned sign panel comprising:

a) a generally rectangular plate like body, having a front side suitable for display of graphics, a back side which provides a surface for structural support, two first ends which are parallel and approximately four feet in length, and two opposite ends which are parallel to each other and perpendicular to said first ends and approximately seven feet in length;

b) raised ribs, connected to the back side of said body, parallel to each other and extending along the seven foot length of said body, providing structural support to said body;

c) double raised ribs, connected to the back side of said body, parallel to each other and perpendicular to said raised ribs, providing structural support to said body, and providing separation lines as guides for separating said body into a plurality of separate pieces;

d) extension ribs, extending from one of said first ends along axes which are parallel to said raised ribs, but which are offset from said axes by an amount equal to the depth of said raised ribs;

e) slots, formed between said raised ribs, and along axes parallel to said raised ribs, providing an opening equal to the depth of said extension ribs, which allow insertion of said extension ribs of a second sign panel;

f) clip channels, formed between said raised ribs, extending along both of said opposite ends, allowing placement of mechanical clips in said clip channels for connecting two sign panels in a side by side relationship.

9. The partitioned sign panel of claim 8 wherein said sign panel is manufactured out of high impact foam.

* * * * *